US011589166B1

(12) United States Patent
Yang

(10) Patent No.: US 11,589,166 B1
(45) Date of Patent: Feb. 21, 2023

(54) SPEAKER

(71) Applicant: AAC Microtech (Changzhou) Co., Ltd., Changzhou (CN)

(72) Inventor: Huhu Yang, Shenzhen (CN)

(73) Assignee: AAC Microtech (Changzhou) Co, , Ltd., Changzhou (CN)

( * ) Notice: Subject to any disclaimer, the term of this patent is extended or adjusted under 35 U.S.C. 154(b) by 0 days.

(21) Appl. No.: 17/560,268

(22) Filed: Dec. 23, 2021

(30) Foreign Application Priority Data

Sep. 22, 2021 (CN) ..... 202122300326.4

(51) Int. Cl.
*H04R 9/02* (2006.01)
*H04R 7/18* (2006.01)

(52) U.S. Cl.
CPC ..... *H04R 9/025* (2013.01); *H04R 7/18* (2013.01); *H04R 2400/11* (2013.01)

(58) Field of Classification Search
CPC ..... H04R 9/025; H04R 7/18; H04R 2400/11
See application file for complete search history.

(56) References Cited

U.S. PATENT DOCUMENTS 10,674,279 B1 * 6/2020 Liu ..... H04R 9/043
2020/0213748 A1 * 7/2020 Liu ..... H04R 9/06

FOREIGN PATENT DOCUMENTS

CN 110121134 A * 8/2019

* cited by examiner

*Primary Examiner* — Angelica M McKinney
(74) *Attorney, Agent, or Firm* — W&G Law Group

(57) ABSTRACT

Provided is a speaker, including: a frame, a vibration unit including a diaphragm, and a voice coil; a magnetic circuit unit including a yoke and a magnet, the magnetic circuit unit being provided with a magnetic gap; and a lower diaphragm. The voice coil is inserted in the magnetic gap to drive the diaphragm to vibrate and produce sound; the lower diaphragm includes an inner connecting portion, an outer connecting portion, and an intermediate portion; the lower diaphragm includes a structural layer and a metal layer; the inner connecting portion includes a first recess, and the outer connecting portion includes a second recess; and the voice coil is electrically connected to the metal layer through the first recess, and the metal layer is electrically connected to an external circuit through the second recess. With this structure, internal space of the speaker is saved, reducing material cost and improving reliability.

9 Claims, 5 Drawing Sheets

A-A

SPEAKER

TECHNICAL FIELD

The present disclosure relates to the technical field of electronic elements, in particular to a speaker.

BACKGROUND

A speaker typically includes a magnetic circuit unit composed of a yoke, a magnet and a pole plate, and a vibration unit composed of a diaphragm, a voice coil and a holder. In order to improve the stability of the vibration unit, a lower diaphragm is usually fixed to a lower end of the voice coil to support the voice coil. Besides, a flexible printed circuit (FPC) is typically provided between the lower end of the voice coil and the lower diaphragm to electrically connect the voice coil to an external circuit. An inner side of the FPC is electrically connected to the voice coil, an outer side of the FPC is electrically connected to the external circuit, and an elastic arm between the inner side and the outer side of the FPC provides an elastic force for elastic vibration.

However, the FPC requires a large internal space of the speaker. A short arm length of the FPC will cause low reliability and fracture of the FPC, and an insufficient internal space of the speaker will result in an interference between the FPC and the lower diaphragm.

To solve the above problem, it needs to provide a speaker with a conductive lower diaphragm.

SUMMARY

An objective of the present disclosure is to provide a speaker with a conductive lower diaphragm.

An embodiment of present disclosure provides a speaker, including: a frame, a vibration unit including a diaphragm fixed to the frame, and a voice coil fixed to the diaphragm, the vibration unit being fixed to the frame; a magnetic circuit unit including a yoke fixed to the frame, and a magnet fixed to a side of the yoke close to the vibration unit, the magnetic circuit unit being provided with a magnetic gap; and at least one lower diaphragm fixed to the voice coil and opposite to and spaced apart from the diaphragm. The voice coil is inserted in the magnetic gap to drive the diaphragm to vibrate and produce sound; the at least one lower diaphragm is fixed to the voice coil and opposite to and spaced apart from the diaphragm; each of the at least one lower diaphragm includes an inner connecting portion fixed to and connected to the voice coil, an outer connecting portion fixed to and connected to the frame, and an intermediate portion connecting the inner connecting portion and the outer connecting portion; each of the at least one lower diaphragm includes a structural layer and a metal layer buried in the structural layer; the inner connecting portion includes a first recess provided in the structural layer to expose the metal layer, and the outer connecting portion includes a second recess provided in the structural layer to expose the metal layer; and the voice coil is electrically connected to the metal layer through the first recess, and the metal layer is electrically connected to an external circuit through the second recess.

As an improvement, the structural layer includes a first structural layer located on a side of the metal layer close to the diaphragm and a second structural layer located on a side of the metal layer away from the diaphragm; and the first recess penetrates through the first structural layer, and the second recess penetrates through the second structural layer.

As an improvement, the voice coil has a racetrack shape; the at least one lower diaphragm includes four lower diaphragms; and the four inner connecting portions of the four lower diaphragms are connected to corners of the voice coil.

As an improvement, the vibration unit further includes a holder for supporting the voice coil in the magnetic gap; the holder includes a body portion having a ring shape and sandwiched between the voice coil and the diaphragm, a first extension portion extending along an outer side surface of the voice coil after bending from the body portion in a direction away from the diaphragm, and a second extension portion extending from an end of the first extension portion away from the body portion in a direction away from the outer side surface of the voice coil; and the inner connecting portion is fixed to the second extension portion.

As an improvement, the magnet includes a main magnet located at a central position and auxiliary magnets that are spaced apart from each other at a peripheral side of the main magnet and spaced apart from the main magnet to form the magnetic gap; the auxiliary magnets include first auxiliary magnets arranged along long edges of the voice coil and second auxiliary magnets arranged along short edges of the voice coil; the first auxiliary magnets are spaced apart from the second auxiliary magnets to form accommodating gaps; and the at least one lower diaphragms are accommodated in the accommodating gaps.

As an improvement, the first extension portion is spaced apart from the outer side surface of the voice coil.

As an improvement, the second extension portion is fixed to a surface of the inner connecting portion facing the diaphragm; and the inner connecting portion is opposite to and spaced apart from the voice coil.

As an improvement, the magnet includes a main magnet located at a central position and auxiliary magnets that are spaced apart from each other at a peripheral side of the main magnet and spaced apart from the main magnet to form the magnetic gap, and the magnetic circuit unit further includes a main pole plate fixed to a surface of the main magnet facing the diaphragm and auxiliary pole plates fixed to surfaces of the auxiliary magnets facing the diaphragm.

As an improvement, a projection of the outer connecting portion along a vibrating direction does not overlap with the yoke.

Compared with the related art, the speaker provided by the present disclosure includes lower diaphragms fixed to the voice coil and opposite to and spaced apart from the diaphragm. The lower diaphragms each include an inner connecting portion fixed to and connected to the voice coil, an outer connecting portion fixed to and connected to the frame, and an intermediate portion connecting the inner connecting portion and the outer connecting portion. The lower diaphragms each include a structural layer and a metal layer buried in the structural layer. The inner connecting portion includes a first recess provided in the structural layer to expose the metal layer. The outer connecting portion includes a second recess provided in the structural layer to expose the metal layer. The voice coil is electrically connected to the metal layer through the first recess, and the metal layer is electrically connected to an external circuit through the second recess. The metal layer is buried in the lower diaphragms, and the voice coil is electrically connected to the external circuit through the metal layer, in this way, it ensures the electrical connection between the voice coil and the external circuit, and eliminates the need for a flexible printed circuit (FPC), saving the internal space of the speaker and reducing the material cost. In this way, a risk of FPC fracture, which would affect the reliability of the speaker, can be avoided; besides, a risk of interference between the conductive lower diaphragms and the FPC can be avoided, thereby achieving a more reliable and stable acoustic performance of the speaker.

DETAILED DESCRIPTION OF EMBODIMENTS

In order to make the objectives, technical solutions and the advantages of the present disclosure clearer, the present disclosure is described in further detail below with reference to the drawings and embodiments. Understandably, the described embodiments are merely intended to explain the present disclosure, rather than to limit the present disclosure. All other embodiments obtained by those of ordinary skill in the art based on the embodiments in the present disclosure without creative efforts should fall within the protection scope of the present disclosure.

Terms such as "first", "second", "third" and "fourth" (if any) in the specification, claims and drawings of the present disclosure are intended to distinguish between similar objects, rather than to necessarily indicate a specific order or sequence. It should be understood that these terms such as "first", "second", "third" and "fourth" may be exchanged under proper conditions to make it possible for the described embodiments of the present disclosure to be implemented in a sequence except those illustrated herein. Moreover, the terms "include", "comprise" and their variants mean to cover a non-exclusive inclusion. For example, a process, method, system, product or device that includes a list of steps or units is not necessarily limited to those steps or units which are clearly listed. Instead, they may include other steps or units which are not expressly listed or inherent.

It should be noted that the terms such as "first" and "second" are used herein only for the purpose of description and are not intended to indicate or imply relative importance, or implicitly indicate the number of the indicated technical features. Therefore, features defined by "first" and "second" may explicitly or implicitly include at least one of the features. Further, the technical solutions of the various embodiments may be combined with each other on the basis that the combination is implementable by those of ordinary skill in the art. In case a combination of the technical solutions is contradictory or infeasible, such a combination is deemed inexistent and not falling within the protection scope of the present disclosure.

Referring to FIGS. 1 to 8, an embodiment of the present disclosure provides a speaker 100. The speaker 100 includes a frame 10, a magnetic circuit unit 20 fixed to the frame 10 and a vibration unit 30 for vibrating and producing sound. The magnetic circuit unit 20 drives the vibration unit 30 to vibrate and produce sound.

Figure 1:
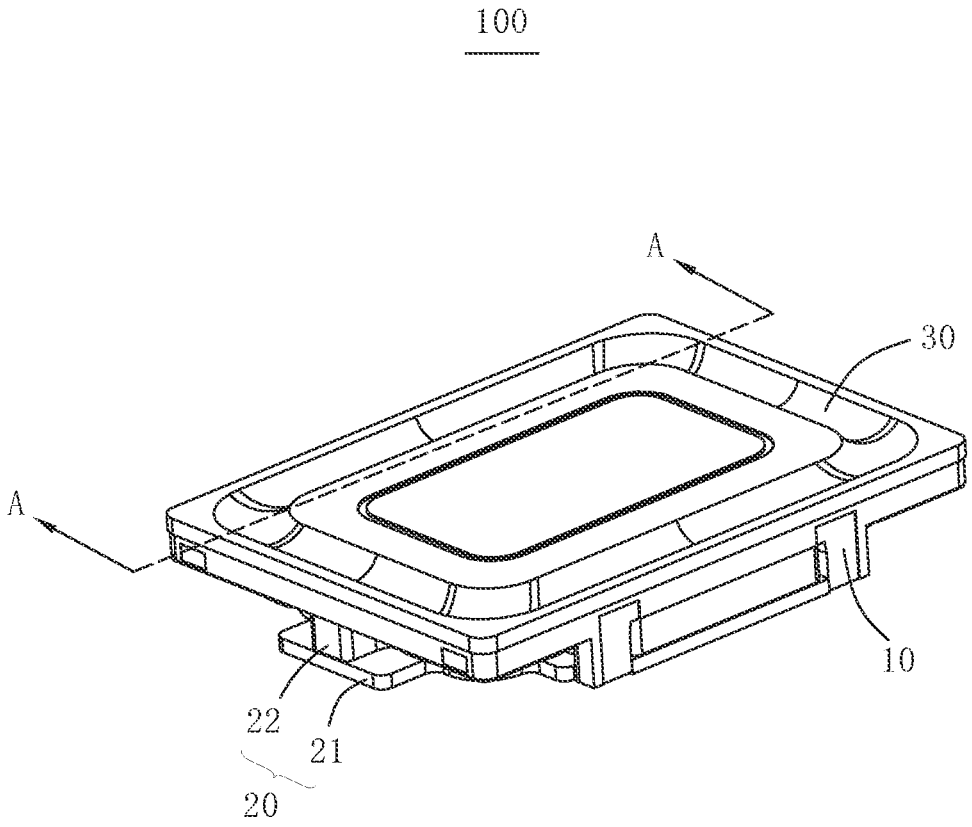
FIG. 1 is a three-dimensional view of a speaker according to an embodiment of the present disclosure.
Figure 2:
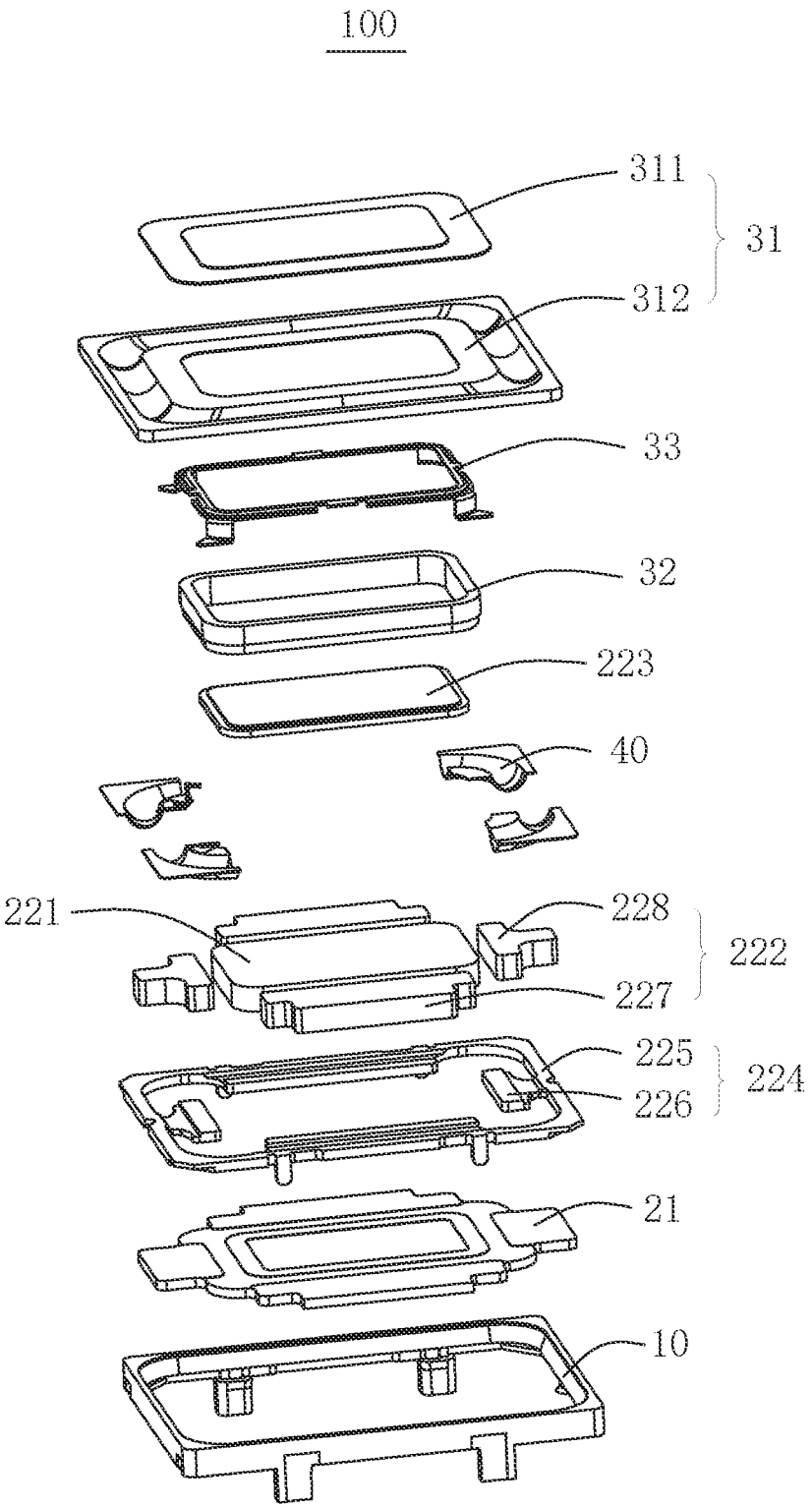
FIG. 2 is an exploded view of a speaker according to an embodiment of the present disclosure.

As shown in FIG. 2, the magnetic circuit unit 20 includes a flat yoke 21 fixed to the frame 10, and a magnet 22 fixed to a central position of the yoke 21. In this embodiment, the magnet 22 includes a main magnet 221 located at a central position, and auxiliary magnets 222 spaced apart from each other at a peripheral side of the main magnet 221. The main magnet 221 is spaced apart from each of the auxiliary magnets 222 to form a magnetic gap.

As shown in FIG. 2 to FIG. 5, the vibration unit 30 includes a diaphragm 31 fixed to the frame 10 and a voice coil 32 fixed to the diaphragm 31. The voice coil 32 is inserted in the magnetic gap to drive the diaphragm 31 to vibrate and produce sound. In this embodiment, the diaphragm 31 includes a dome 311 located at a central position, and a suspension 312 surrounding the dome 311. The dome 311 is fixed to an inner edge of the suspension 312, and an outer edge of the suspension 312 is fixed to the frame 10.

In this implementation, as shown in FIG. 2, the magnetic circuit unit 20 further includes a main pole plate 223 fixed to a surface of the main magnet 221 facing the diaphragm 31, and a pole plate 224 fixed to the auxiliary magnets 222. Specifically, the pole plate 224 includes a ring-shaped pole plate body 225, and auxiliary pole plates 226 extending from the pole plate body 225. The auxiliary pole plates 226 are fixed to surfaces of the auxiliary magnets 222 facing the diaphragm 31. The main pole plate 223 and the auxiliary pole plate 226 allow the magnetic induction lines emitted by the main magnet 221 and the auxiliary magnets 222 more concentrated, reducing the magnetic force loss and improving the driving force of the magnetic circuit unit 20. The pole plate body 225 is fixed to the frame 10 so as to integrally fix the magnetic circuit unit 20 to the frame 10 to form a fixed structure. Specifically, there are four auxiliary magnets 222. Correspondingly, the pole plate body 225 has a racetrack shape. Four auxiliary pole plates 226 are formed by extending from two long edges and two short edges of the pole plate body 225.

As shown in FIG. 2 to FIG. 8, the speaker 100 further includes lower diaphragms 40 fixed to the voice coil 32 and opposite to and spaced apart from the diaphragm 31. The lower diaphragms 40 each include an inner connecting portion 41 fixed to and connected to the voice coil 32, an outer connecting portion 42 fixed to and connected to the frame 10, and an intermediate portion 43 connecting the inner connecting portion 41 and the outer connecting portion 42. Specifically, as shown in FIG. 5 to FIG. 8, the lower diaphragms 40 each include a structural layer 44 and a metal layer 45 buried in the structural layer 44. The inner connecting portion 41 includes a first recess 411 provided in the structural layer 44 to expose the metal layer 45. The outer connecting portion 42 includes a second recess 421 provided in the structural layer 44 to expose the metal layer 45. The voice coil 32 is electrically connected to the metal layer 45 through the first recess 411, and the metal layer 45 is electrically connected to the outer connecting portion through the second recess 421, thereby achieving electrical connection between the voice coil 32 and an external circuit.

Specifically, the structural layer 44 includes a first structural layer 441 located on a side of the metal layer 45 close to the diaphragm 31, and a second structural layer 442 located on a side of the metal layer 45 away from the diaphragm 31. The first recess 411 penetrates through the first structural layer 441, and the second recess 421 penetrates through the second structural layer 442. In other embodiments, the first recess 411 may also be provided in the second structural layer 442, and the second recess 421 may also be provided in the first structural layer 441, mainly depending on the winding condition of the voice coil 32 and the welding manner of the external circuit.

Specifically, the voice coil 32 has a racetrack shape. Correspondingly, there are four lower diaphragms 40. The four lower diaphragms 40 are respectively provided at four corners of the voice coil 32, that is, four inner connecting portions 41 are respectively connected to the corners of the voice coil 32. It is understandable that only two of the four lower diaphragms 40 need to be connected to lead wires of the voice coil 32. The two lower diaphragms 40 can be arbitrarily selected from the four lower diaphragms 40 to be electrically connected to the voice coil 32, depending on the winding situation of the voice coil 32.

As shown in FIG. 2 to FIG. 6, the vibration unit 30 further includes a holder 33 for supporting the voice coil 32 in the magnetic gap. The holder 33 includes a ring-shaped body portion 331 sandwiched between the voice coil 32 and the diaphragm 31, first extension portions 332 extending along an outer side surface of the voice coil 32 after bending from the body portion 331 in a direction away from the diaphragm 31, and second extension portions 333 extending from ends of the first extension portions 332 away from the body portion 331 in a direction away from the outer side surface of the voice coil 32. The inner connecting portions 41 of the lower diaphragms 40 are fixed to the second extension portions 333. It should be understood that the outer side surface of the voice coil 32 is a surface parallel to a vibrating direction and away from the main magnet 221. Specifically, the first extension portions 332 are spaced apart from the outer side surface of the voice coil 32. The second extension portions 333 are fixed to surfaces of the inner connecting portions 41 facing the diaphragm 31, and the inner connecting portions 41 are opposite to and spaced apart from the outer side surface of the voice coil 32. The first extension portions 332 and the second extension portions 333 are spaced apart from the voice coil 32, to effectively avoid noise caused by collision with the voice coil 32 during vibration. That is, the lower diaphragms 40 are fixed to and connected to the voice coil 32 through the holder 33.

Figure 3:
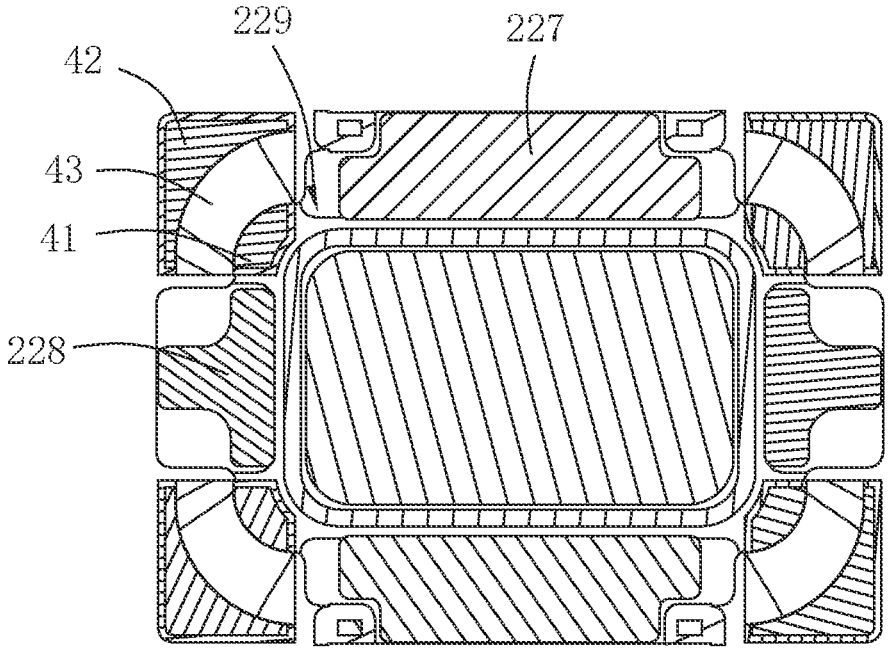
FIG. 3 is a sectional view of a speaker according to an embodiment of the present disclosure.
Figure 4:
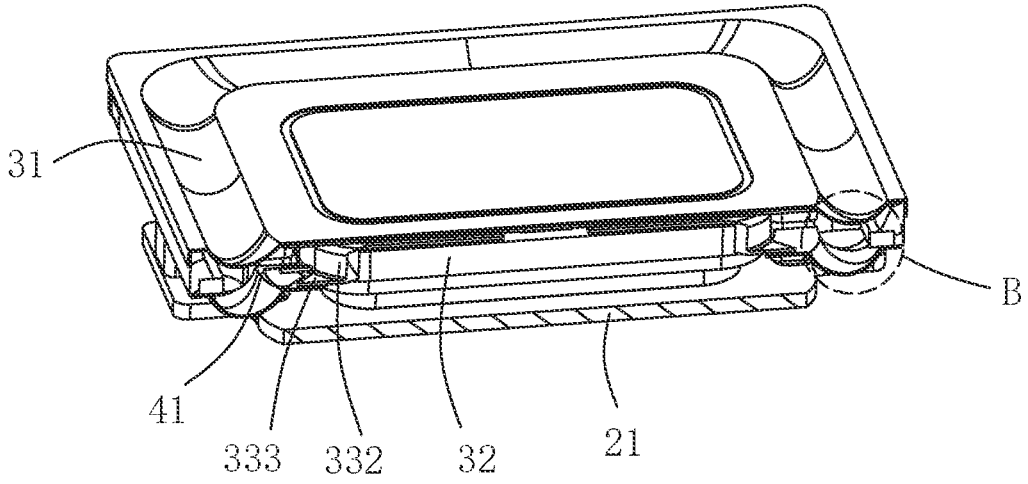
FIG. 4 is a sectional view of the speaker taken along line A-A in FIG. 1.
Figure 5:
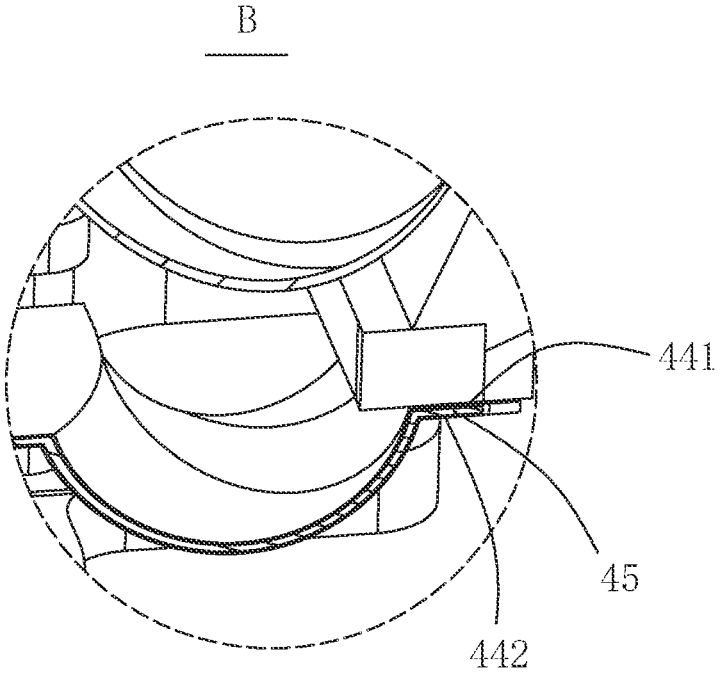
FIG. 5 is an enlarged view of B shown in FIG. 4.
Figure 6:
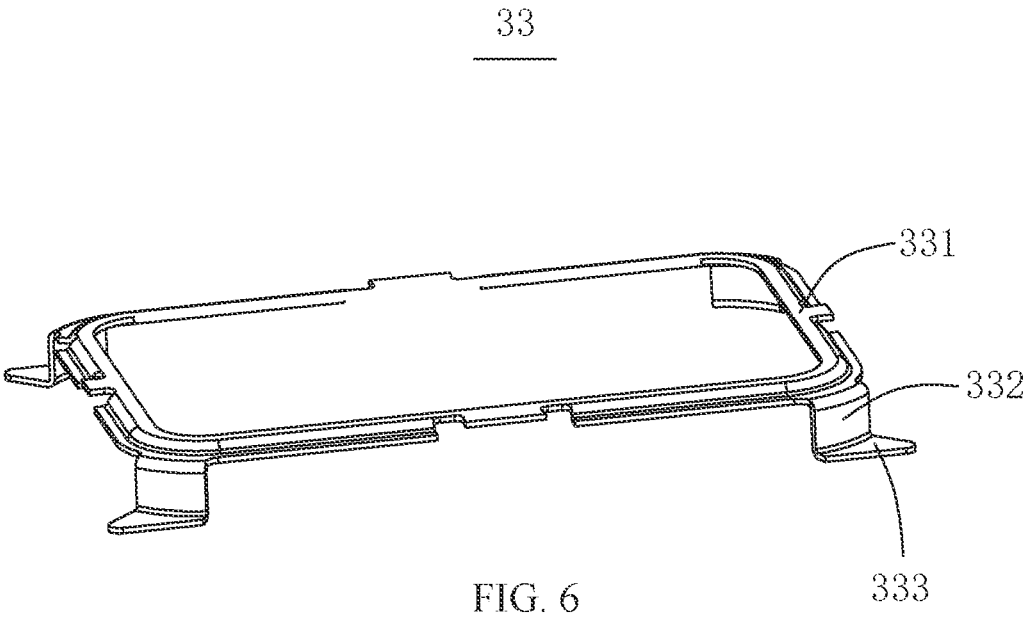
FIG. 6 is a view illustrating a holder of a speaker according to an embodiment of the present disclosure.
Figure 7:
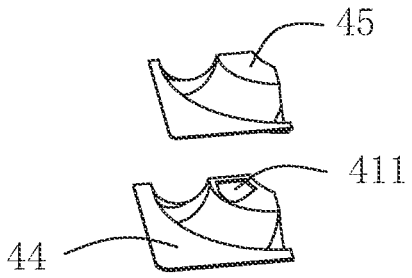
FIG. 7 is a view of a lower diaphragm of a speaker according to an embodiment of the present disclosure.
Figure 8:
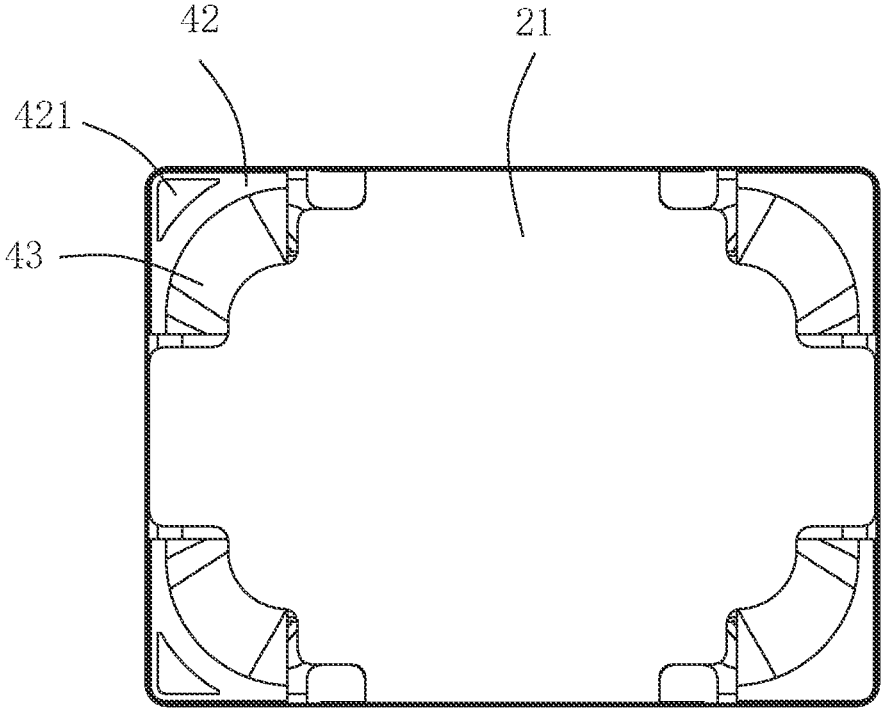
FIG. 8 is a top view of a speaker according to an embodiment of the present disclosure.

Specifically, as shown in FIG. 2 and FIG. 3, the auxiliary magnets 222 include first auxiliary magnets 227 arranged along long edges of the voice coil 32 and second auxiliary magnets 228 arranged along short edges of the voice coil 32. The first auxiliary magnets 227 are spaced apart from the second auxiliary magnets 228 to form accommodating gaps 229, and the lower diaphragms 40 are accommodated in the accommodating gaps 229.

Compared with the related art, the speaker 100 provided by the present disclosure includes lower diaphragms 40 fixed to the voice coil 32 and opposite to and spaced apart from the diaphragm 31. The lower diaphragms 40 each include an inner connecting portion 41 fixed to and connected to the voice coil 32, an outer connecting portion 42 fixed to and connected to the frame 10, and an intermediate portion 43 connecting the inner connecting portion 41 and the outer connecting portion 42. The lower diaphragms 40 each include a structural layer 44 and a metal layer 45 buried in the structural layer 44. The inner connecting portion 41 includes a first recess 411 provided in the structural layer 44 to expose the metal layer 45. The outer connecting portion 42 includes a second recess 421 provided in the structural layer 44 to expose the metal layer 45. The voice coil 32 is electrically connected to the metal layer 45 through the first recess 411, and the metal layer 45 is electrically connected to an external circuit through the second recess 421. The metal layer 45 is buried in the lower diaphragms 40, and the voice coil 32 is electrically connected to the external circuit through the metal layer 45, in this way, it ensures the electrical connection between the voice coil 32 and the external circuit, and eliminates the need for a flexible printed circuit (FPC), saving the internal space of the speaker and reducing the material cost. In this way, a risk of FPC fracture, which would affect the reliability of the speaker, can be avoided; besides, a risk of interference between the conductive lower diaphragms and the FPC can be avoided, thereby achieving a more reliable and stable acoustic performance of the speaker.

The above described are merely implementations of the present disclosure. It should be noted here that those of ordinary skill in the art may make improvements without departing from the concept of the present disclosure, but such improvements should fall within the protection scope of the present disclosure.

What is claimed is:

1. A speaker, comprising:

a frame, a vibration unit comprising a diaphragm fixed to the frame, and a voice coil fixed to the diaphragm, the vibration unit being fixed to the frame;

a magnetic circuit unit comprising a yoke fixed to the frame, and a magnet fixed to a side of the yoke close to the vibration unit, the magnetic circuit unit being provided with a magnetic gap; and at least one lower diaphragm fixed to the voice coil and opposite to and spaced apart from the diaphragm, wherein the voice coil is inserted in the magnetic gap to drive the diaphragm to vibrate and produce sound; the at least one lower diaphragm is fixed to the voice coil and opposite to and spaced apart from the diaphragm; each of the at least one lower diaphragm comprises an inner connecting portion fixed to and connected to the voice coil, an outer connecting portion fixed to and connected to the frame, and an intermediate portion connecting the inner connecting portion and the outer connecting portion; each of the at least one lower diaphragm comprises a structural layer and a metal layer buried in the structural layer; the inner connecting portion comprises a first recess provided in the structural layer to expose the metal layer, and the outer connecting portion comprises a second recess provided in the structural layer to expose the metal layer; and the voice coil is electrically connected to the metal layer through the first recess, and the metal layer is electrically connected to an external circuit through the second recess.

2. The speaker as described in claim 1, wherein the structural layer comprises a first structural layer located on a side of the metal layer close to the diaphragm and a second structural layer located on a side of the metal layer away from the diaphragm; and the first recess penetrates through the first structural layer, and the second recess penetrates through the second structural layer.

3. The speaker as described in claim 2, wherein a projection of the outer connecting portion along a vibrating direction does not overlap with the yoke.

4. The speaker as described in claim 1, wherein the voice coil has a racetrack shape; the at least one lower diaphragm comprises four lower diaphragms; and the four inner connecting portions of the four lower diaphragms are connected to corners of the voice coil.

5. The speaker as described in claim 1, wherein the vibration unit further comprises a holder for supporting the voice coil in the magnetic gap; the holder comprises a body portion having a ring shape and sandwiched between the voice coil and the diaphragm, a first extension portion extending along an outer side surface of the voice coil after bending from the body portion in a direction away from the diaphragm, and a second extension portion extending from an end of the first extension portion away from the body portion in a direction away from the outer side surface of the voice coil; and the inner connecting portion is fixed to the second extension portion.

6. The speaker as described in claim 5, wherein the first extension portion is spaced apart from the outer side surface of the voice coil.

7. The speaker as described in claim 5, wherein the second extension portion is fixed to a surface of the inner connecting portion facing the diaphragm; and the inner connecting portion is opposite to and spaced apart from the voice coil.

8. The speaker as described in claim 1, wherein the magnet comprises a main magnet located at a central position and auxiliary magnets that are spaced apart from each other at a peripheral side of the main magnet and spaced apart from the main magnet to form the magnetic gap; the auxiliary magnets comprise first auxiliary magnets arranged along long edges of the voice coil and second auxiliary magnets arranged along short edges of the voice coil; the first auxiliary magnets are spaced apart from the second auxiliary magnets to form accommodating gaps; and the at least one lower diaphragms are accommodated in the accommodating gaps.

9. The speaker as described in claim 1, wherein the magnet comprises a main magnet located at a central position and auxiliary magnets that are spaced apart from each other at a peripheral side of the main magnet and spaced apart from the main magnet to form the magnetic gap, and the magnetic circuit unit further comprises a main pole plate fixed to a surface of the main magnet facing the diaphragm and auxiliary pole plates fixed to surfaces of the auxiliary magnets facing the diaphragm.

* * * * *